US012336604B2

(12) United States Patent
Green et al.

(10) Patent No.: US 12,336,604 B2
(45) **Date of Patent: *Jun. 24, 2025**

(54) WEARABLE HOLDER FOR SECURING A SMART WATCH

(71) Applicant: TWELVE SOUTH, LLC, Mt. Pleasant, SC (US)

(72) Inventors: Andrew Bradford Green, Mt. Pleasant, SC (US); Christina Tapp, Mt. Pleasant, SC (US)

(73) Assignee: TWELVE SOUTH, LLC, Mt. Pleasant, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/222,797

(22) Filed: Apr. 5, 2021

(65) Prior Publication Data

US 2021/0289895 A1 Sep. 23, 2021

Related U.S. Application Data

(63) Continuation of application No. 15/881,556, filed on Jan. 26, 2018, now Pat. No. 10,966,492.

(60) Provisional application No. 62/450,691, filed on Jan. 26, 2017.

(51) Int. Cl.

| | |
|---|---|
| ***A44C 5/14*** | (2006.01) |
| ***A44C 5/00*** | (2006.01) |
| ***A44C 5/20*** | (2006.01) |
| ***A45F 5/00*** | (2006.01) |

(52) U.S. Cl.

CPC ..... *A44C 5/14* (2013.01); *A44C 5/0053* (2013.01); *A44C 5/20* (2013.01); *A44C 5/2071* (2013.01); *A45F 5/00* (2013.01); *A44D 2205/00* (2013.01); *A45F 2005/008* (2013.01); *A45F 5/1516* (2025.01); *A45F 5/1525* (2025.01)

(58) Field of Classification Search

CPC ..... G04B 47/00; G04B 37/00; G04B 29/00; A45C 11/00; A45C 13/00; G06F 1/16; A45F 2005/008; A45F 5/00; A44C 5/14; A44C 5/20

See application file for complete search history.

(56) References Cited

U.S. PATENT DOCUMENTS

| | | | | |
|---|---|---|---|---|
| 5,008,864 A * | 4/1991 | Yoshitake | H04B 1/385 | 379/430 |
| 5,392,261 A * | 2/1995 | Hsu | G04B 37/1413 | 368/281 |
| 5,657,298 A * | 8/1997 | Choay | G04B 37/1413 | 368/300 |
| 5,899,370 A * | 5/1999 | Bould | A44C 5/0053 | 224/175 |

(Continued)

*Primary Examiner* — Brian D Nash

(74) *Attorney, Agent, or Firm* — Wayne Edward Ramage; Baker Donelson

(57) ABSTRACT

A versatile smart device holder that secures the device to a user while offering enhanced protection during physical activity as compared to conventional device bands and holders. The device holder is suitable to wear in a number of locations, such as across the bicep, the forearm, leg, ankle, or the wrist. The device holder comprises a band made of flexible material and a frame permanently or removably embedded within or attached to the band that is capable of securely holding the electronic device in place.

17 Claims, 8 Drawing Sheets

(56) References Cited

U.S. PATENT DOCUMENTS

| | | | | |
|---|---|---|---|---|
| 6,646,864 | B2 * | 11/2003 | Richardson | G06F 1/1626 312/223.1 |
| 6,971,789 | B2 * | 12/2005 | Nakamura | G04B 37/04 368/300 |
| 8,345,412 | B2 * | 1/2013 | Maravilla | A45F 5/00 361/679.01 |
| 8,967,437 | B2 * | 3/2015 | Wilson | G04B 37/1486 224/152 |
| 9,004,329 | B2 * | 4/2015 | Hsieh | A44C 5/00 224/221 |
| 9,483,024 | B2 * | 11/2016 | Goyet | G04B 47/046 |
| 9,737,123 | B2 * | 8/2017 | Wright | A45C 13/008 |
| D809,953 | S * | 2/2018 | Gilmore | D11/3 |
| 9,918,541 | B2 * | 3/2018 | Byun | A45F 5/02 |
| 10,966,492 | B2 * | 4/2021 | Green | A44C 5/2071 |
| 2007/0049365 | A1 * | 3/2007 | Norris | G08B 5/223 455/575.8 |
| 2012/0134244 | A1 * | 5/2012 | Margaritelli | G04B 47/046 63/3 |
| 2016/0357324 | A1 * | 12/2016 | Smith | G06F 3/04817 |
| 2017/0035190 | A1 * | 2/2017 | Gilmore | A45F 5/00 |
| 2018/0213895 | A1 * | 8/2018 | Green | A44C 5/2071 |

* cited by examiner

WEARABLE HOLDER FOR SECURING A SMART WATCH

This application is a continuation of U.S. patent application Ser. No. 15/881,556, filed Jan. 26, 2018, which claims benefit of and priority to U.S. Provisional Application No. 62/450,691, filed Jan. 26, 2017, both of which are incorporated herein in their entireties by specific reference for all purposes, and is entitled to the benefit of those filing dates.

FIELD OF INVENTION

This invention relates generally to a wearable holder for a smart watch or similar portable electronic device that is particularly suited for use during athletic or other physical activities.

BACKGROUND OF THE INVENTION

Smart watches, such as the Apple Watch, are extremely versatile, stylishly designed timepieces that can be quite expensive, ranging from several hundred dollars to over a thousand dollars. Given the portability and functionality of smart watches and the availability of numerous fitness-related apps, this device can function as a highly advanced health and fitness tool. Many physical activities or sports, such as kickboxing and weightlifting, require full wrist mobility; yet conventional smart watch bands tether the device to the wrist, making it impossible to wear a smart watch while participating in such activities. In addition, conventional smart watch bands do not provide adequate protection for the expensive device while the user participates in high intensity physical activity.

Accordingly, what is needed is a versatile band that secures a smart watch to a user while offering enhanced protection during physical activity and is suitable to wear in a number of locations, such as across the bicep, the forearm, leg, ankle, or the wrist.

SUMMARY OF THE INVENTION

In various exemplary embodiments, the present invention comprises a wearable smart watch holder with a band and frame that receives and holds a smart watch, such as, but not limited to, the Apple Watch. Embodiments are particularly useful for securing a smart watch to a user during physical activity. Various embodiments permit the watch to be worn around multiple body parts or extremities, including, but not limited to, the wrist, biceps, forearm, leg, or ankle.

In non-limiting embodiments, the band is between about 5 inches and about 30 inches in length, inclusive. In certain embodiments, the band is between 10 inches and 20 inches long, inclusive. In other exemplary embodiments, the band is between 15 inches and 20 inches in length, inclusive. Embodiments allow the band to fit a user's extremities that have a circumference between about 4 inches and about 28 inches. Certain exemplary embodiments allow the band to fit the user's extremities that have a circumference between about 8 inches and about 20 inches, inclusive. Still other embodiments allow the band to fit the user's extremities that have a circumference between about 9 inches and about 17 inches, inclusive. In non-limiting embodiments, the band is between about 0.5 inches and 3 inches in width, inclusive. In other embodiments, the band is about 1.5 inches in width. In certain embodiments, the band is about 2 inches wide.

In certain embodiments, the band is comprised of a single, continuous piece with an opening in the form of a notch, hole, slot, or gap that allows for insertion of a frame, which will serve to hold the smart watch. In embodiments, the band is wider at the frame opening. The frame opening may be located closer to one end of the band.

In several embodiments, the band attaches to the user's extremity via a magnetic, clasp, or other suitable mechanism. In certain embodiments, the band utilizes a hook-and-loop fastener (e.g., Velcro-type) or similar mechanism for securing the watch holder to the user's extremity. In these embodiments, an elongated strip of hook-and-loop material is attached to the outer face of the band adjacent to a shortened strip of hook-and-loop material is also attached to the outer face, adjacent to the elongated Velcro-type strip. In these embodiments, the shortened strip and the elongated strip of hook-and-loop material are complementary to one another (i.e., one strip comprises a hook material and the other strip comprises a loop material). In certain embodiments, the elongated strip of is positioned between the shortened strip and the band's frame opening.

In various embodiments, the band further comprises an elongated ring that is sewn or attached to the end of the band which is opposite from the end of the band comprising the hook-and-loop material. In embodiments, the elongated ring is so dimensioned to allow the opposite strap to pass through the ring, creating an enclosure that surrounds the user's extremity. In these exemplary embodiments, the band is tightened around the user's extremity, and the two complementary hook-and-loop strips are pressed together to secure the band to the user.

In certain embodiments, the band allows a tight and consistent contact with the skin such that the smart watch's heartrate functionality is maintained or improved as compared to a conventional wrist watch band.

The frame that receives and holds the smart watch may be integrated within the band or separate. If separate, the frame may be removably or permanently attached to the band, or may fit within a slot, groove, or opening in the band. The frame may be located closer to one end of the band or may be centered on the band. In certain embodiments, the frame is positioned adjacent to the previously mentioned elongated ring.

In further embodiments, the frame comprises an opening that is configured to allow the smart watch to be easily inserted and removed. In embodiments, the frame allows a user to insert the smart watch through the back face of the frame such that the face of the watch is accessible to the user when wearing the watch holder.

In several embodiments, the frame comprises a bumper that surrounds and protects the smart watch during physical activity. In embodiments, the bumper has a notch, gap, slot, or hole on one side that is configured to allow access to the smart watch's digital crown. The bumper may also comprise a slightly raised portion that allows the user to easily access any buttons on the smart watch. In embodiments, the frame comprises openings that correspond to the watch's built in microphones to allow for maximum vocal clarity when using the smart watch's voice-activated functions. In certain embodiments, the frame may be configured to allow the smart watch to be recessed within the frame such that the watch face is protected during physical activity.

In several embodiments, the band may be comprised of cloth, fabric, leather, or an elastomeric material such as rubber or neoprene. In certain embodiments, the band may be comprised of a flexible material such as silicone. In embodiments, the frame is comprised of a flexible, impact-resistant material. In certain embodiments the frame is comprised of silicone or similar material. In certain embodiments the watch holder is comprised of washable material.

The present invention thus allows a smart watch or similar device to be securely attached to a user during physical activity while allowing a user to conveniently view and utilize the full functionality of the watch.

DETAILED DESCRIPTION OF EXEMPLARY EMBODIMENTS

Figure 1:
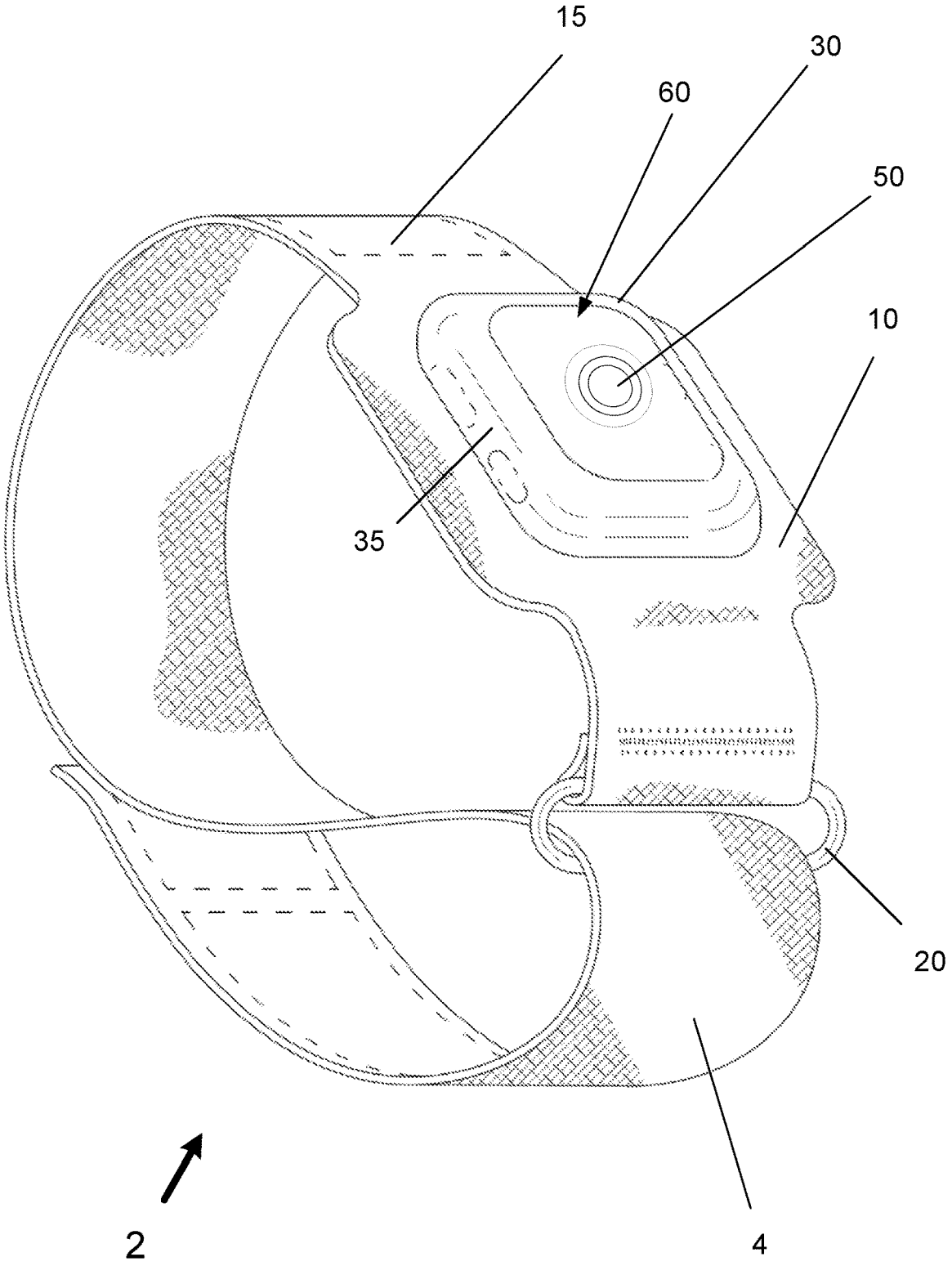
FIG. 1 shows a view of the outer face of the watch holder in an open configuration without an inserted smart watch.

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate manner.

In various exemplary embodiments, as described herein and seen in FIGS. 1-8, the watch holder 2 comprises a band 4 and a frame 30. The frame 30 is permanently or removably embedded within or attached to the band 4, and the watch face 50 is accessible to the user. In this embodiment, the frame comprises bumpers 35, which serve to protect the smart watch during physical activity. As shown in the embodiments of FIGS. 1-6, the band is wider at the frame opening 10. The frame may be attached in a watch-holding portion of the band, which may be greater in width than the rest of the band.

Referring now to the embodiments shown in FIGS. 1-4, a first elongated strip of hook-and-loop, or Velcro-type, material 15 is attached to the outer face of the band, and a second, shortened strip of hook-and-loop material 5 is also attached to the outer face, adjacent to the elongated hook-and-loop material. In these embodiments, the shortened strip and the elongated strip of hook-and-loop material are complementary to one another (i.e., one comprises a hoop material and the other comprises a hook material).

In certain embodiments, the elongated strip of hook-and-loop material 15 is positioned between the shortened strip of hook-and-loop material 5 and the band's frame opening 10. In embodiments, the band comprises an elongated ring 20 that is sewn to the end of the band that is opposite from the end of the band comprising the hook-and-loop material. In embodiments, and as shown in FIG. 1, the elongated ring is so dimensioned to allow the opposite strap to pass through the ring, creating an enclosure that surrounds the user's extremity. In these exemplary embodiments, the band is tightened around the user's extremity, and the two complementary hook-and-loop strips 5, 15 are pressed together to secure the band to the user.

Figure 2:
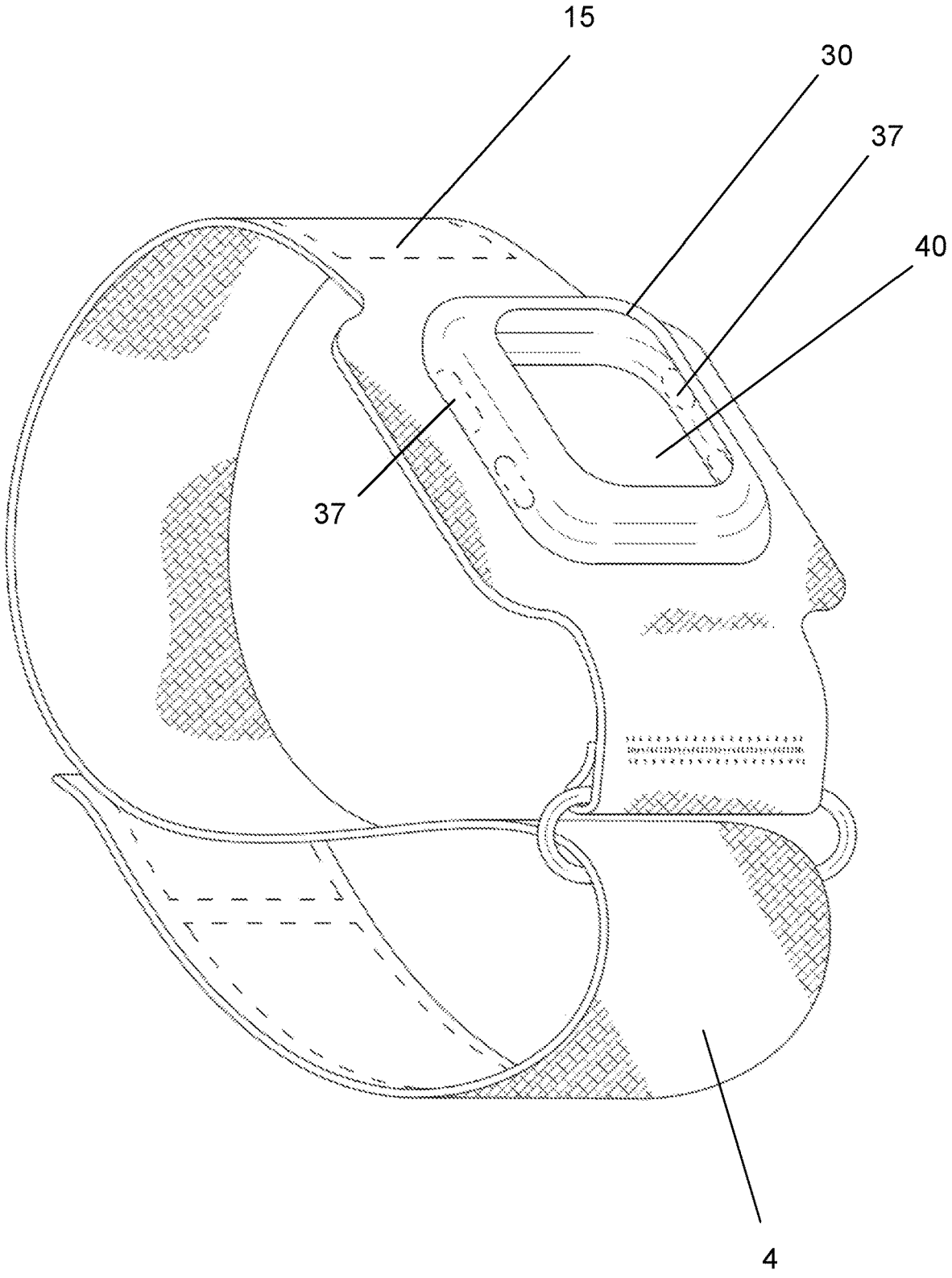
FIG. 2 shows a view of the inner face of the watch holder in an open configuration without an inserted smart watch.
Figure 3:
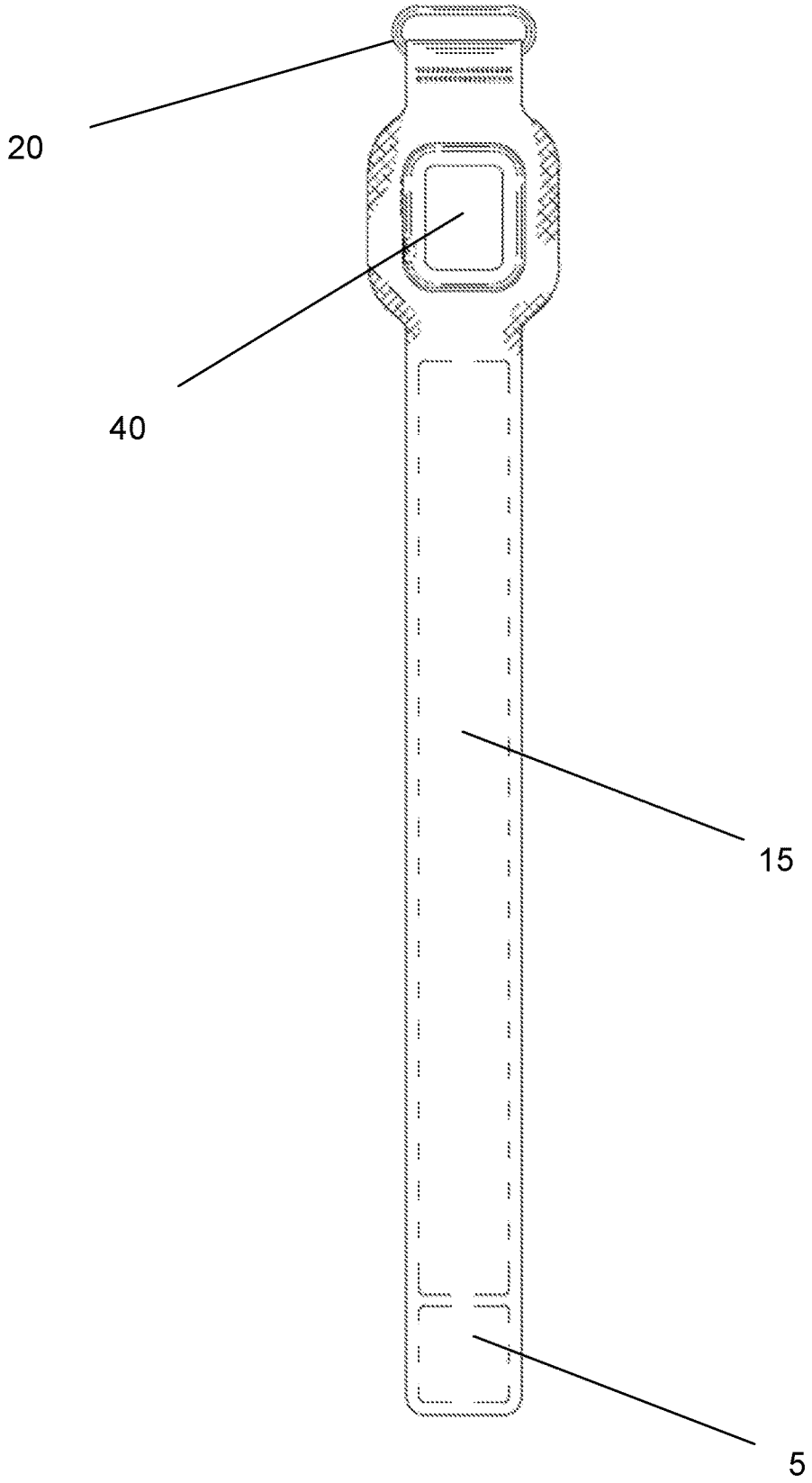
FIG. 3 shows a top view of the watch holder.
Figure 4:
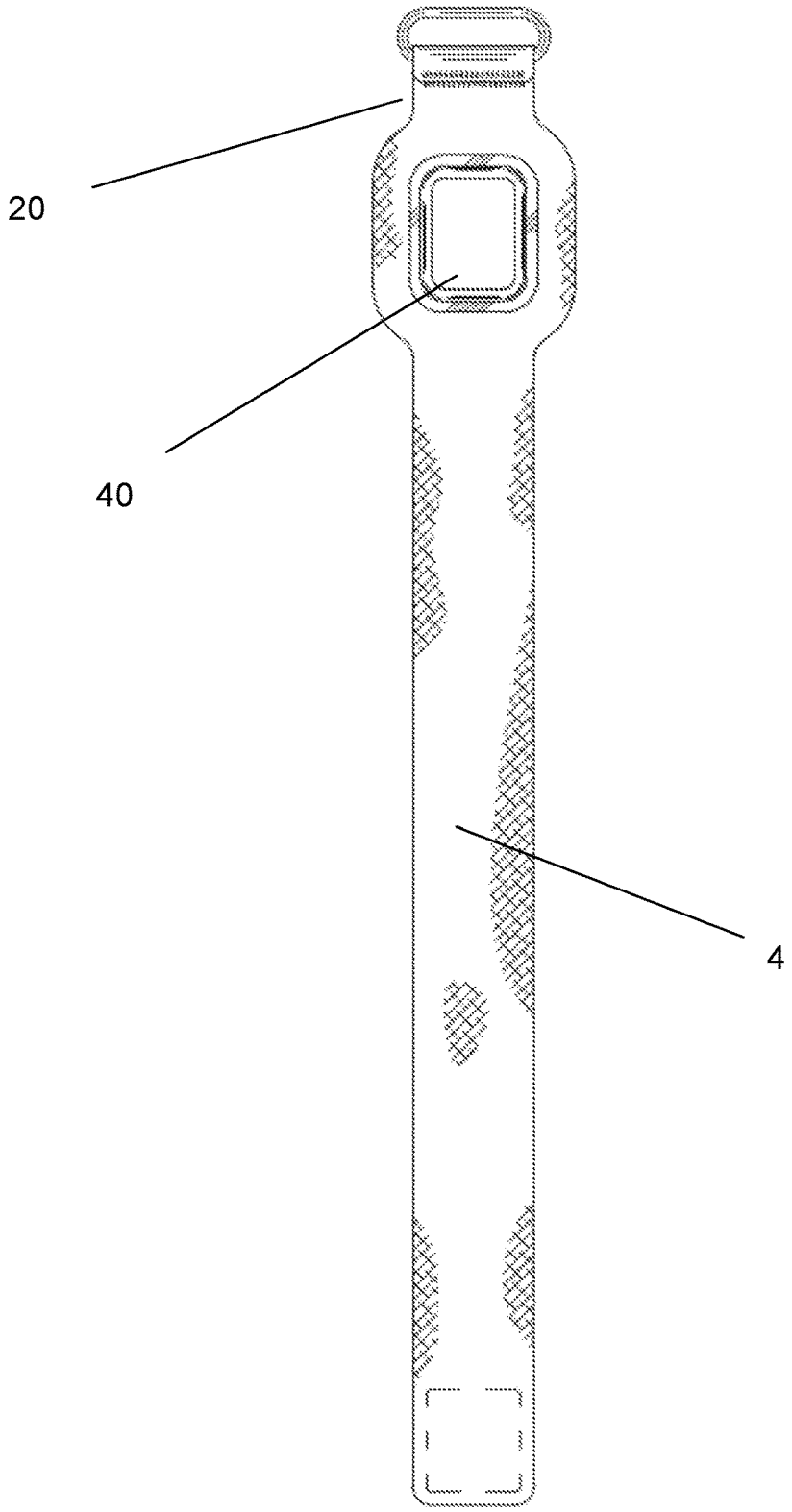
FIG. 4 shows a bottom view of the watch holder.
Figure 5:
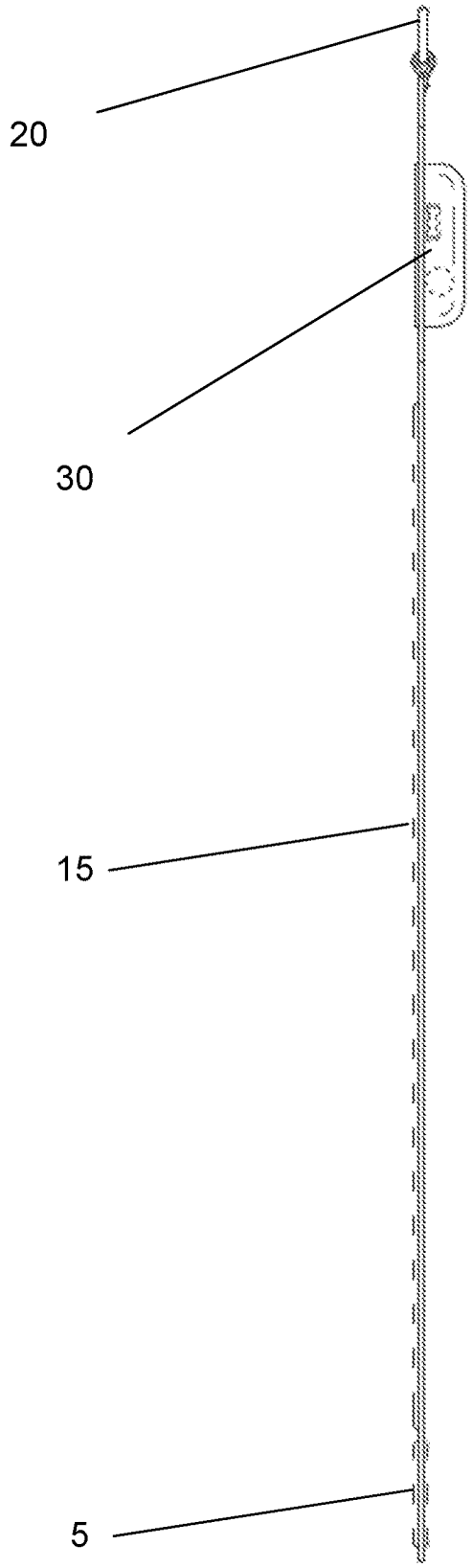
FIG. 5 shows a left side view of the watch holder.
Figure 6:
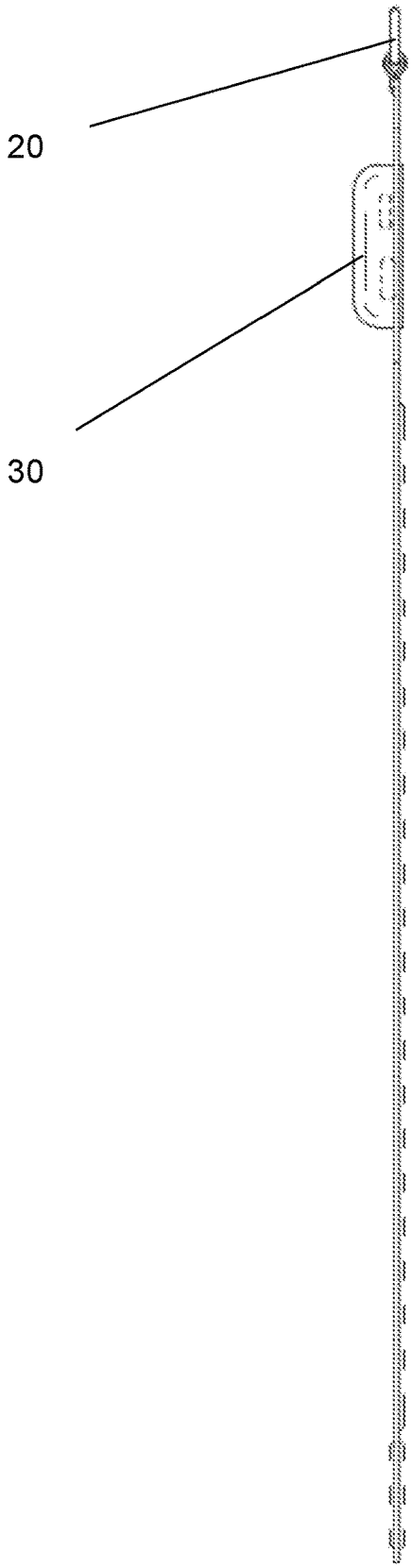
FIG. 6 shows a right side view of the watch holder.
Figure 7:
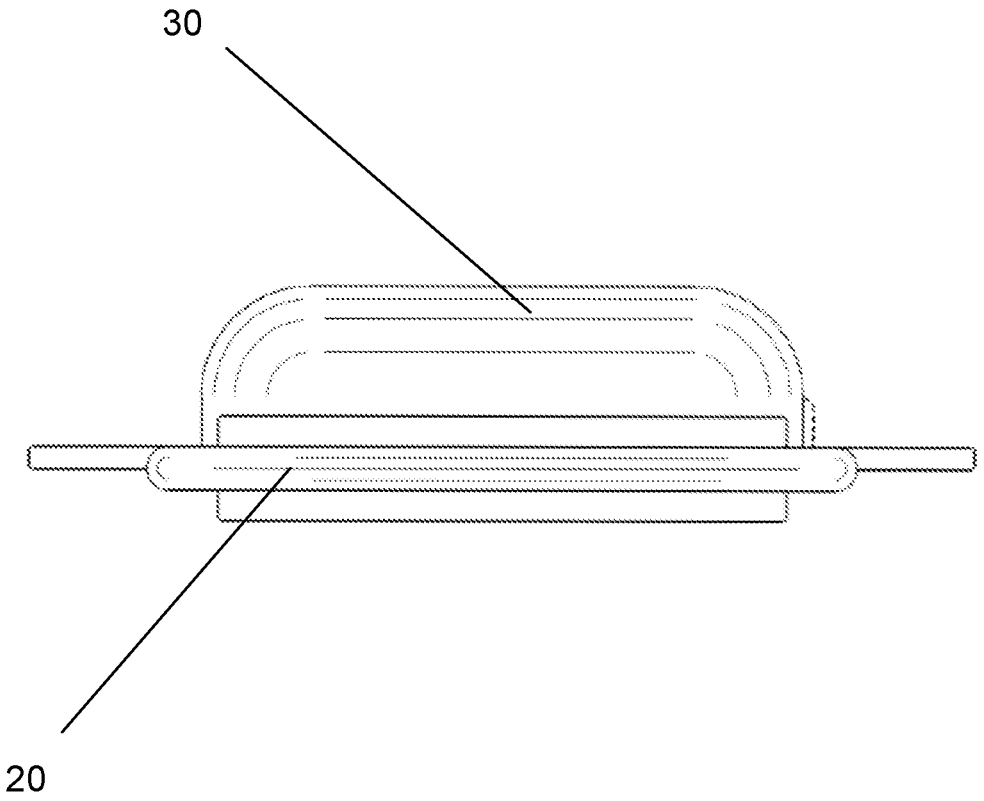
FIG. 7 shows an end view of the watch holder.
Figure 8:
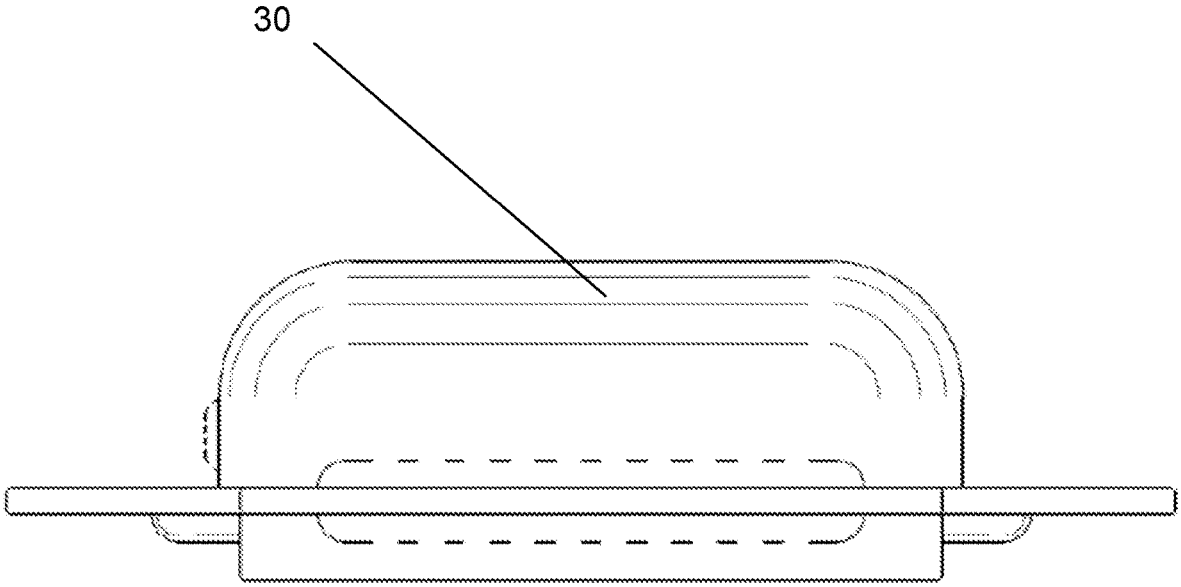
FIG. 8 shows an opposite end view of the watch holder

The exemplary embodiments of FIGS. 1 and 2 show the frame 30 with an opening 40 that is configured to allow the smart watch to be easily inserted and removed. As shown in FIGS. 1 and 2, the frame 30 allows a user to insert the smart watch 60 through the back face of the frame. When so inserted, the watch 60 is securely held in place by the frame 30, which may include a inward-trending rim along the top of the frame bumpers.

The embodiments of FIGS. 1 and 2 show the frame bumpers 35 with a notch, gap, slot, or hole on one side that is configured to allow access to the smart watch's digital crown 37. In these exemplary embodiments, the bumpers 35 also comprise a slightly raised portion 37 that allows the user to easily access any buttons on the smart watch through thin areas or openings. In additional embodiments, the frame bumpers comprise thin areas or openings that correspond to the watch's built in microphones to allow for maximum vocal clarity when using the smart watch's voice-activated functions.

The frame may be of the same material and color as the band, or may be different in material, color, and/or texture. In one embodiment, the frame is composed of silicone or similar material (to provide for impact resistance).

The present invention may be made of any suitable material, including, but not limited to, cloth, fabric, leather, plastic, rubber, neoprene, silicone, or combinations thereof. It also may be provided in a variety of colors or textures, or combinations thereof.

In one exemplary embodiment, the band is approximately 1.57 inches wide and the open, widened portion 10 is approximately 2.56 inches wide. The frame may be configured to securely hold smart watches of varying sizes. In certain embodiments the frame may be configured to securely hold smart watches of either 38 mm or 42 mm in width.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A watch holder, comprising:

a single-piece band comprising a single continuous strip with a first end, a second end, an outer surface, and an inner surface, and a watch-holding portion disposed in a middle section of the band between the first end and second end; and a watch-holding frame attached to the watch-holding portion of the band, said frame comprising a protective frame bumper extending for some or all of the outer circumference of the frame; and a hole in the watch-holding portion, wherein the watch-holding frame is configured to be inserted into the hole.

2. The watch holder of claim 1, wherein the watch-holding frame is permanently attached or embedded in the watch-holding portion of the band.

3. The watch holder of claim 1, wherein a portion of the protective frame bumper is raised above the outer surface of the strip.

4. The watch holder of claim 1, further comprises a ring on the first end of the strip.

5. The watch holder of claim 4, wherein a first strip of hook-and-loop material is attached to the outer surface of the strip proximate the second end of the strip and a second strip of complementary hook-and-loop material is attached to the outer surface of the strip between the first strip of hook-and-loop material and the watch-holding portion.

6. The watch holder of claim 5, wherein the second strip of complementary hook-and-look material is longer than the first strip of hook-and-loop material.

7. The watch holder of claim 6, wherein the second end of the strip is configured to be inserted through the ring, and the band secured by attachment of the first strip of hook-and-loop material to the second strip of complementary hook-and-look material.

8. The watch holder of claim 1, the watch-holding frame further comprising an open top, and configured to securely hold a smart watch.

9. The watch holder of claim 8, further comprise one or more thin areas on the bumpers configured to align with buttons or controls on the watch when inserted therein.

10. A watch holder, comprising:

a single-piece band comprising a single continuous strip with a first end, a second end, an outer surface, and an inner surface, and a watch-holding portion disposed in a middle section of the band between the first end and second end; and a watch-holding frame attached to the watch-holding portion of the band, said frame comprising a protective frame bumper extending for some or all of the outer circumference of the frame, wherein the watch-holding frame is removably attached or embedded in the watch-holding portion of the band.

11. A watch holder, comprising:

a single-piece band comprising a single continuous strip with a first end, a second end, an outer surface, and an inner surface, and a watch-holding portion disposed in a middle section of the band between the first end and second end; and a watch-holding frame attached to the watch-holding portion of the band, said frame comprising a protective frame bumper extending for some or all of the outer circumference of the frame, and an open top, and configured to securely hold a smart watch;

the watch-holding frame further comprising an open bottom, wherein the smart watch is insertable through said open bottom.

12. The watch holder of claim 11, wherein the watch-holding frame is permanently attached or embedded in the watch-holding portion of the band.

13. The watch holder of claim 11, wherein the watch-holding frame is removably attached or embedded in the watch-holding portion of the band.

14. The watch holder of claim 11, further comprises a ring on the first end of the strip.

15. The watch holder of claim 14, wherein a first strip of hook-and-loop material is attached to the outer surface of the strip proximate the second end of the strip and a second strip of complementary hook-and-loop material is attached to the outer surface of the strip between the first strip of hook-and-loop material and the watch-holding portion.

16. The watch holder of claim 15, wherein the second strip of complementary hook-and-look material is longer than the first strip of hook-and-loop material.

17. The watch holder of claim 16, wherein the second end of the strip is configured to be inserted through the ring, and the band secured by attachment of the first strip of hook-and-loop material to the second strip of complementary hook-and-look material.

* * * * *